US005804144A

United States Patent [19]

Tervamäki

[11] Patent Number: 5,804,144

[45] Date of Patent: Sep. 8, 1998

[54] PISTON PIPETTE

[75] Inventor: Jukka Tervamäki, Helsinki, Finland

[73] Assignee: Labsystems OY, Helsinki, Finland

[21] Appl. No.: 870,291

[22] Filed: Jun. 6, 1997

Related U.S. Application Data

[63] Continuation of Ser. No. 537,671, filed as PCT/FI94/00149, Apr. 20, 1994, abandoned.

[30] Foreign Application Priority Data

Apr. 21, 1993 [FI] Finland ..... 931806

[51] Int. Cl.[6] ..... B01L 3/02

[52] U.S. Cl. ..... 422/100; 422/99; 436/180; 73/864.16; 73/864.18; 222/287; 222/309

[58] Field of Search ..... 422/100, 101, 422/102, 103, 104; 73/864.16, 864.18; 436/180; 222/287, 309, 321.1

[56] References Cited

U.S. PATENT DOCUMENTS

| | | | |
|---|---|---|---|
| Re. 32,210 | 7/1986 | D'Autry | 73/864.14 |
| 3,827,305 | 8/1974 | Gilson et al. | 73/425.6 |
| 4,099,548 | 7/1978 | Sturm et al. | 141/27 |
| 4,141,250 | 2/1979 | D'Autry | 73/425.6 |
| 4,284,604 | 8/1981 | Tervamaki | 422/100 |
| 4,406,170 | 9/1983 | Kuhn | 73/864.16 |
| 5,012,682 | 5/1991 | Sabloewski | 73/864.18 |
| 5,018,364 | 5/1991 | Gilson | 73/864.18 |
| 5,104,624 | 4/1992 | Labriola | 422/100 |
| 5,320,810 | 6/1994 | Al-Mahareeq et al. | 422/100 |
| 5,330,721 | 7/1994 | Tervamaki | 422/100 |

*Primary Examiner*—Harold Y. Pyon
*Attorney, Agent, or Firm*—Armstrong, Westerman, Hattori, McLeland & Naughton

[57] ABSTRACT

A piston pipette having pulling equipment for moving a piston upward and pushing equipment for moving the piston downward. The pushing equipment has a movable gripping device (5), which when moving downward is attached to the piston and transfers the piston downward, and a movable transfer device (4) extending below the gripping device. According to the structure a pipette is obtained which is gripped a pen-shape handle and with which liquid can be dosed to a desired place as exactly as possible.

20 Claims, 3 Drawing Sheets

PISTON PIPETTE

This application is a File Wrapper continuation of application Ser. No. 08/537,671 filed Oct. 19, 1995, now abandoned and a continuation of PCT/FI94/00149 filed Apr. 20, 1994.

BACKGROUND OF THE INVENTION

1. Field of Technology

The invention relates to the handling of liquids and it concerns a hand-held piston pipette.

2. Description of the Prior Art

Manually operated piston pipettes are usually provided with a knob at the piston rod by which the piston is moved by pressing with the thumb. Such a pipette is known, for example, from publication FI-C-47461 (corresponds, for example, to publication U.S. Pat. No. 3,810,391).

In a so-called step pipette the liquid volume drawn into the pipette cylinder is metered out in several smaller doses. In the step pipette the piston rod usually has teeth and the body has a matching striker always pushing the piston downward over the desired distance during a dosing stroke. One such pipette is known, for example, from publication U.S. Pat. No. 4,099,548 wherein the top end of the body has a thumb-operated push knob. Publication GB-A-2048712 again presents a similar step pipette, wherein in the side of the top part of the body there is a forefinger-operated dosing push button.

In some step pipettes the striker actuator is a lever journalled in the body in its top part above the striker point. The lever is operated with the thumb. One such step pipette is known, for example, from publication DE-A-2926691 (corresponds, for example, to publication GB-A-2057581). This pipette also has a volume control device having a longitudinally moving covering plate above the teeth. The striker always moves over a standard distance, but part of the movement is along the covering plate off the teeth. Thus the distance covered by the piston is dependent on the location of the plate.

In conventional pipettes the pipette is gripped by the hand, so that the pipette must by necessity be made quite long. Dosing liquid to a very small place is difficult with such a pipette and in any case requires a very steady hand and great carefulness.

Known electrically operating pipettes are also gripped with the hand and the operating button is located in the upper part of the body. Such pipettes are described, for example, in publications FI-A-742083 (corresponds, for example, to publication U.S. Pat. No. 4,058,370) and FI-A-932942 (corresponds, for example, to publication EP-A-576967).

SUMMARY OF THE INVENTION

The pipette according to the invention is designed to be gripped like a pencil. Thus liquid can be dosed very precisely with the pipette even to very small places. The pipette is particularly suitable for use in certain laboratory work and in assembly glueing. The pipette may be a step pipette or a one-dose pipette. It may be manually operated or electrically operating.

In a manually operated pipette according to the invention there is a gripping means attaching to a piston for moving the piston downward, but also allowing the piston to be pulled upward. The pipette has a transfer means extending below the gripping means and joined to this and preferably also associated with a separate push button. The pipette body may have a longitudinal gap partly open at least on one side for the cylinder and the piston.

The transfer means is preferably spring-operated so that it will always return to its original position after the transfer movement.

The transfer means is movable in the longitudinal body direction so that the top position of the transfer means also corresponds with the top position of the gripping means. The transfer means is preferably on one side of the body. Hereby the opposite side of the body may have an open gap through which an exchangeable cylinder and piston can be mounted.

The transfer means is also preferably joined to an operating lever articulated to the body and articulated to the transfer means.

The pipette may also have a stroke length control means.

A point vessel into which liquid is drawn can be used at the cylinder end. However, the cylinder may function at the same time also as a liquid container and both the cylinder and the piston can be exchangeable.

The pipette can be provided, for example, with a spring means for pulling the piston upward. However, a step pipette is preferably only provided with a piston knob for pulling the piston upward by hand. Then the body is preferably provided with a stop to prevent the piston from escaping from the cylinder. In addition, the pipette may have equipment for controlling the liquid volume to be drawn into the pipette.

In a step pipette one transfer movement of the transfer means transfers the piston downward only by a stroke of a certain length out of the entire distance of the piston movement. Thus, the liquid volume drawn into the pipette is discharged from the pipette in several smaller doses. The stroke length control means may have, for example, a stop which moves in the body direction and which limits the upper position of the striker.

In a step pipette a spring is preferably connected to the gripping means for pressing down the moving gripping means against the piston rod. The device is also preferably provided with a releaser automatically to release the gripping means from the piston when the gripping means is in its top position in relation to the piston, whereby the piston can be easily pulled up to its top position.

BRIEF DESCRIPTION OF THE DRAWINGS

Some applications of the invention are described in the following as examples. In the drawings of the description

DESCRIPTION OF A PREFERRED EMBODIMENT

Figure 1:
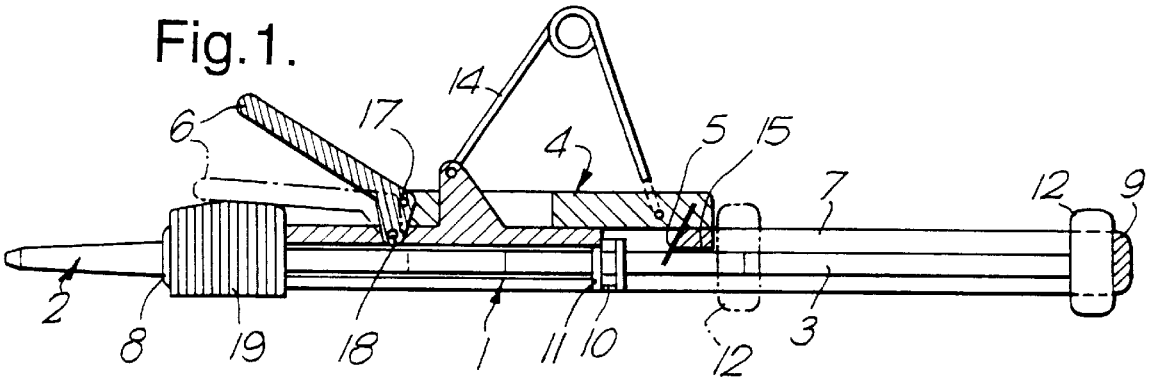
FIG. 1 is a side view, partly in section, of a step pipette in accordance with the present invention.

The main parts of the pipettes shown as examples, in FIG. are a body 1*a,* cylinder 2 and a piston 3, as well as a striker 4, which functions as a transfer means, and connected to a gripping means 5 and an operating lever 6.

The body has a longitudinal gap 7. At the lower body end the gap 7 is open only to one side of the body and at the upper end, the gap 7 extends through the body, forming a sliding slot for the rod of piston 3. At the lower body end, hole 8 forms an extension to the gap. At the upper end an end stop 9 closes the gap.

Figure 2:
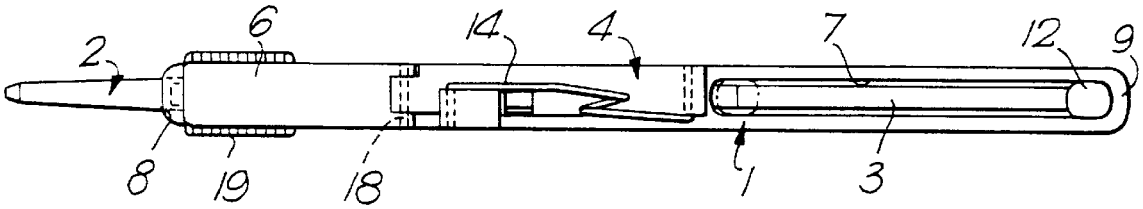
FIG. 2 is a top view of the pipette in FIG. 1.
Figure 3:
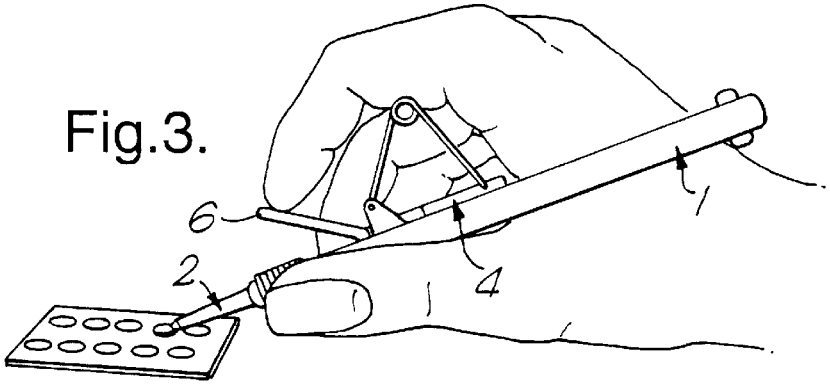
FIG. 3 is a side view, similar to FIG. 3 but showing the pipette in use.
Figure 9:
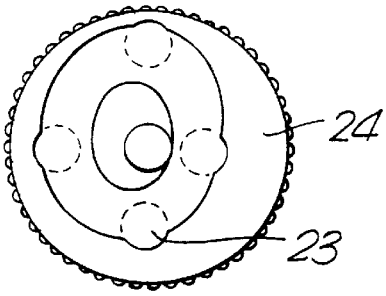
FIG. 9 is a top view of the control equipment of the pipette of FIGS. 6–8.

The cylinder and piston 3, in FIGS. 1 and 2, are placed in gap 7 so that the cylinder head extends out of hole 8 at the lower body end. At the top end of the cylinder there is a peak-like flange 10, which at the mid-point of the body is pushed into a transverse groove 11 opening to the open side of the gap. In this way the cylinder is prevented from moving in a longitudinal direction. The piston has a rod emerging at the upper cylinder end which at its end in a sliding slot has a pulling knob 12 with edges extending from the gap to the sides of the body. Liquid is drawn into the cylinder by pulling the piston upward at the knob. Stop 9, at the top end of the sliding slot, prevents the piston from being pulled out of the cylinder by mistake. The figures show the piston both in its top and lower positions.

The striker 4 is located in the body 1 on the opposite side of gap 7 to slide longitudinally in a groove. The top end of the striker 4 has a sliding slot containing gripping means 5, which co-operates with the rod of piston 3 and which when moving downward will grip the piston rod and move it downward, but which when moving upward is free of the piston rod, thus not moving the piston.

In the pipette shown in FIGS. 1 and 2 gripping means 5 is a sharp link pressing onto the surface of the rod of piston 3 obliquely from above, thus biting into the piston rod. This gives the advantage that the stroke length can be controlled steplessly by limiting the striker's movement in some suitable way.

In the pipette according to FIGS. 4 and 5 and 6 and 7 the rod of piston 3 is provided on the striker side with teeth 13 and the gripping means 5 is a sharp cam pressing obliquely from above into teeth 13. In this way the gripping means is made to operate more reliably, but control can only be arranged stepwise. The teeth are made easily at the same time as the piston.

The striker 4 is connected together with a spring 14, which forces the striker 4 upward against stop 15 in the sliding slot. The lower stop end is chamfered at the top and thus it lifts gripping means 5 off the rod of piston 3 when the gripping means is forced to its top position.

In the pipette according to FIGS. 1 and 2, spring 14 is a bent wire spring having its lower end attached to the body 1 and its top end to the striker. The spring pushes the striker against stop 15.

Figure 4:
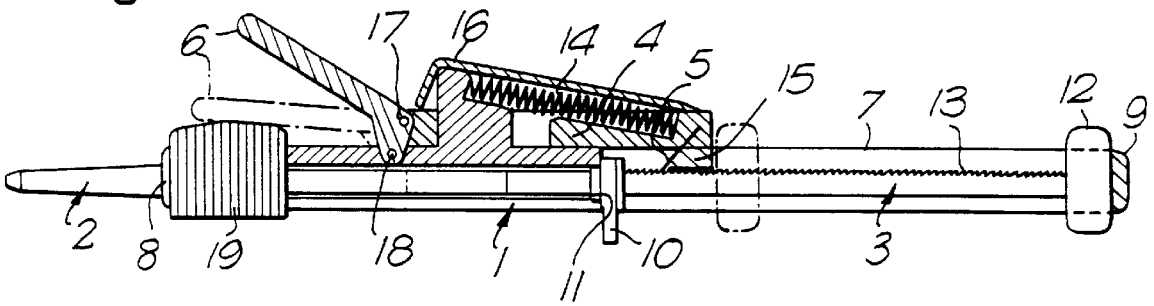
FIG. 4 is a side view, similar to FIG. 1, but showing another embodiment of the invention.
Figure 5:
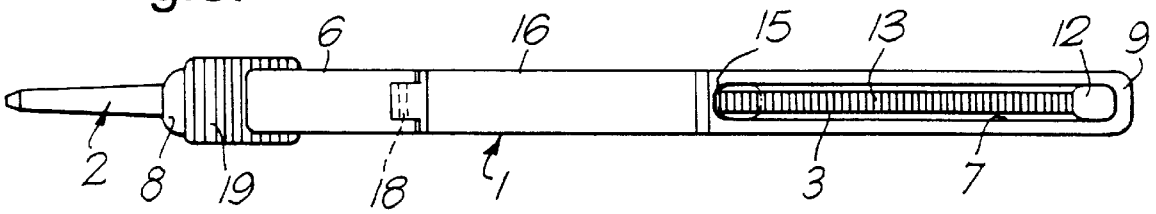
FIG. 5 is a top view of the pipette of FIG. 4.
Figure 6:
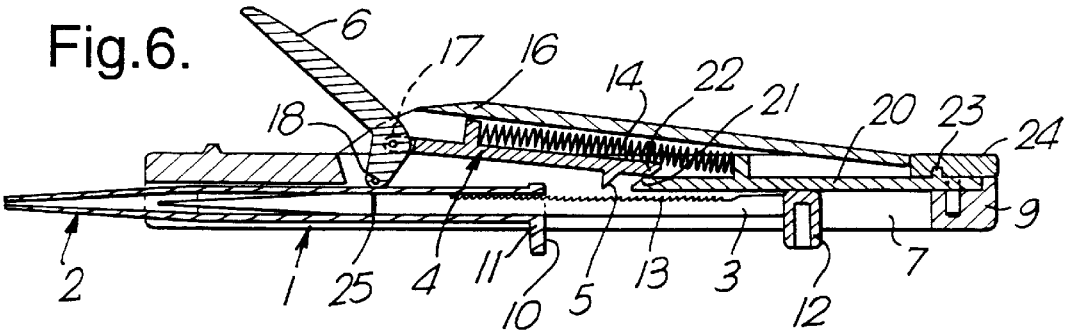
FIG. 6 shows a three step pipette according to the invention in an initial dosing position.

In the pipette according to FIGS. 4 and 6 spring 14' is a helical spring having its lower end supported against a support in the body and its top end against the striker 4. In FIG. 4 the spring 14' pushes the striker 4' against stop 15. The helical spring is covered by plate 16.

Figure 7:
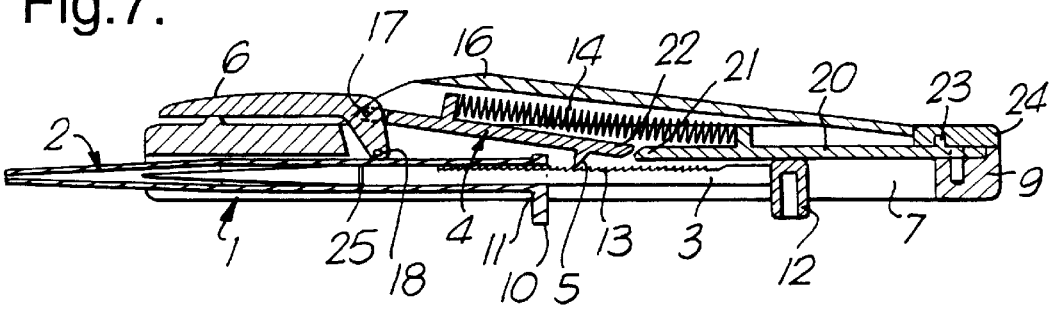
FIG. 7 shows the pipette of FIG. 6 in the end position.

In the pipette according to FIGS. 6 and 7 spring 14" is a draw-spring having one end attached to the striker 4" and the other end to a control rod 20 located at the top body end.

At the lower end of the striker 4" there is also a striker operating lever 6 articulated at point 17 with its other end articulated at a lower point 18 in the body. The free lever end is bent downward. The turning point of the lever in the striker 4" is closer to the body than the support point of the lower end of spring 14". In this way the spring pushes the striker both upward against stop 24 and inward against the rod of piston 3. By pressing at operating lever 6 the piston is made to move a step at a time downward.

The pipettes are also provided with a device for controlling the stroke length of the striker. In the pipette according to FIGS. 1–5 it is a bushing 19 at the lower body end moving longitudinally of the body and the free end of operating lever 6 is pressed against it when dosing liquid. The upper the location of the bushing the shorter naturally is the stroke. The bushing and the body may have suitable friction means to prevent the bushing from sliding inadvertently. In the pipette according to FIGS. 4 and 5 the bushing also has a transparent plate with a reading line. The body has a corresponding scale from which the volume to be dosed can be read.

In the pipette according to FIGS. 6 and 7 the top body end has a control rod 20 movable lengthwise of the body. Its lower end 21 works as a cam to lift the top end 22 of the striker off the teeth 13 when the striker is in its top position. Gripping means 5 is located in the striker at an interval from its top end. Thus, the position of the control rod determines at which point the gripping means will engage with the teeth. At the top end of the control rod a transverse pin 23 is fitted to move in a cam groove rotating eccentrically in control disc 24. The rod position can thus be controlled—by rotating the disc. The body and control disc are provided with a scale from which the volume corresponding to a dosing stroke can be read. Plate 16 also covers spring 14 and the control rod 20.

FIGS. 6 and 7 also show the shape of piston 3 which corresponds to the cylinder 2 shape narrowing conically from below sealing point 25. Groove 7 here extends all the way to the lower body end.

Figure 8:
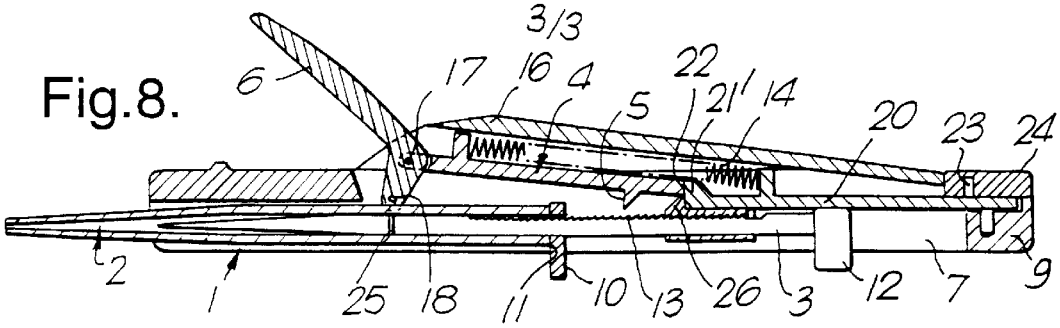
FIG. 8 shows a four step pipette, according to the invention

In the pipette according to FIG. 8 the lower end 21' of control rod 20 functions as a stop for the top position of striker 4". In its top position the striker rises to disengage from teeth 13 with the aid of cam 26 located on one side of the teeth. This gives the advantage that there is no idle motion during the early stroke, because gripping means 5 engages with the teeth at once as the striker leaves its top position. In addition, the position of lever 6 gives a clear picture and feel of the volume to be dosed. In the pipette according to FIGS. 6–8 spring 14" pulls control rod 20 downward. In the groove in control disc 24 there is a recess at each place corresponding to a volume to be set and pin 23 comes to rest in this recess.

Figure 10:
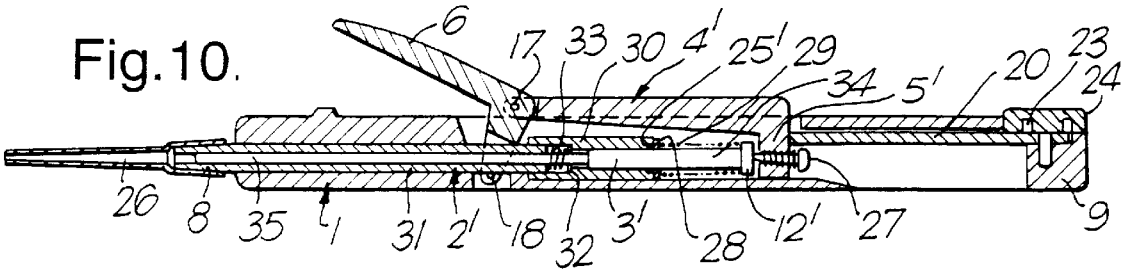
FIG. 10 shows a one-dose pipette according to the invention in the initial position.
Figure 11:
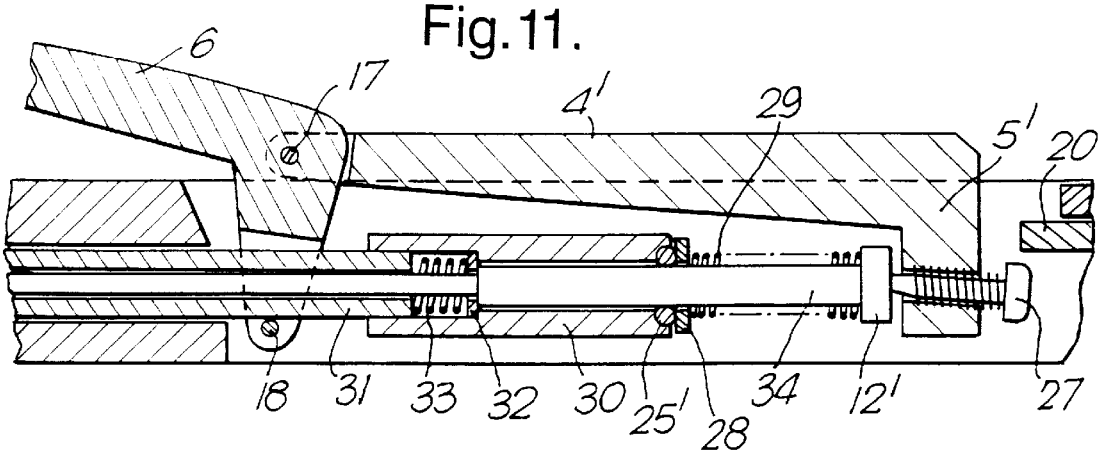
FIG. 11 is a partially enlarged view of the pipette of FIG. 10 in its initial drawing-in stage.
Figure 12:
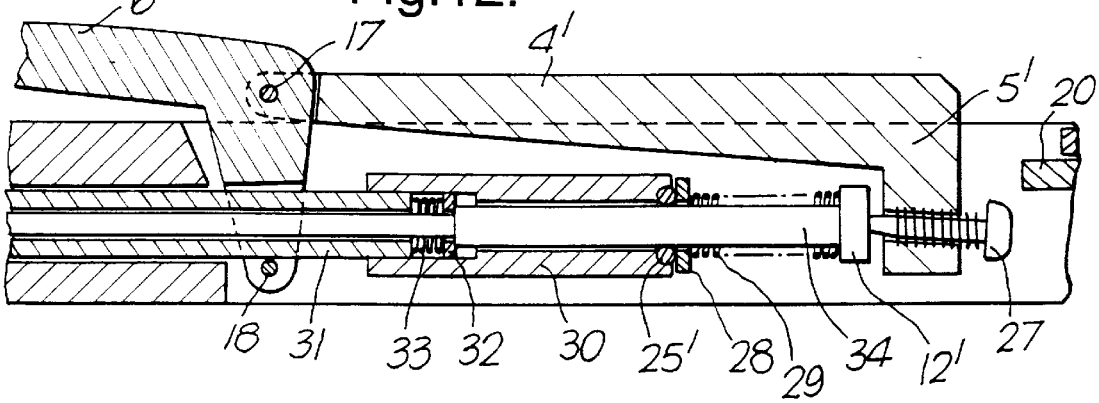
FIG. 12 is a partially enlarged view of the pipette in FIG. 10 in an emptying stage.

FIGS. 10–12 show a one-dose pipette according to the invention having a replaceable point container 26. The equipment for volume control is similar to that in FIGS. 5–8. Here gripping means 5' is a push button located transversely at the top end of striker 4' and corresponding to flange 12' at the top end of piston 3'.

Push button 5' is free of flange 12'. A calibrating screw 27 is threaded through the push button against flange 12' to allow exact control of the piston position in relation to the push button.

The top end of cylinder 2' has a sealing ring 25' on top of which is a compression flange 28. Located between the compression flange and flange 12' at the top end of the rod of piston 3' is a primary spring 29 pressing the piston against push button 5'.

Cylinder 2' has a broader top part 30 with a narrower bottom part 31 attached to an enlarged bore in its bottom end so that an annular hollow space is left between them. In this space there is a secondary support formed like a disc and between this and the top end of the bottom part of the cylinder there is a spring 33 pressing the secondary support upward. Piston 3' too has a broader top part 34 and a narrower bottom part 35. With the piston in its top position the bottom end of top part 34 is above secondary support 32 (FIG. 10).

When taking liquid into the pipette the piston is pressed downward against the force of spring 29 until the bottom end of the piston top part 34 meets secondary support 28 (FIG. 11), whereby one feels when secondary spring 33 begins resisting the movement. The head end of container 26 is brought into the liquid to be dosed and the primary spring is allowed to return the piston to its top position. When discharging liquid from the pipette the piston is pushed further downward, that is, also against the force of the secondary spring (FIG. 12), whereby the container is emptied as completely as possible.

The pipette according to the invention is gripped like a pencil and operating lever 6 is pushed with the forefinger. The pipette can thus be brought very precisely even to a small object. Dosing too is easy.

The pipette is especially suitable for use, for example, in certain immunofluorescence determinations performed with glass plates (FIG. 3), where liquid must be dosed onto very small areas. When dosing, the hand may also be supported against the table, which is not possible when using conventional pipettes.

The pipette is also very suitable for glueing requiring high precision, for example, in assembly jobs. Nowadays glue is usually dosed from a compressable, bottle in such jobs. Using a pipette according to the invention is much easier and the doses are essentially more exact. Nor will the glue dry in the cylinder so easily as in a bottle.

It is understandable that within the scope of the invention many kinds of different pipettes can be constructed and that the purpose of the pipette also affects the construction possibilities. Decisive factors are in particular the pipette size, the desired draw-in volume, the required dosing precision, the special nature of the liquid (for example, viscosity) and on what kind of object and in what doses the liquid will be dosed. Many different construction possibilities exist especially as regards the gripping means and its transfer means as well as possible springs, the operating lever and the volume control equipment.

I claim:

1. A piston pipette having a longitudinal body having a cylinder space and forming a pen-shaped handle and having a top end and a lower end, a cylinder in said cylinder space, said cylinder having a point extending outwardly from said lower end of said body and having a liquid opening in said point and an open upper end, a piston extending inwardly into said open upper end of said cylinder and having an integral rod emerging from an upper end of said cylinder and moving means for moving said piston upward and downward in said cylinder, said moving means including transfer means movable in the longitudinal direction of said piston rod between a top position and a bottom position of said longitudinal body for moving said piston downward in said cylinder, said transfer means having attached thereto a gripping means which, when moved downward, moves said piston upward in said cylinder, said transfer means extending below said gripping means, said pipette further including a control rod for determining the position of engagement of said gripping means with said piston rod; a spring attached to said transfer means and to said control rod, said spring being arranged to pull said transfer means, with said attaching means, in the direction toward said top end of said longitudinal body and toward said piston rod upon movement of said transfer means toward said bottom position of said longitudinal body.

2. A pipette as recited in claim 1, wherein said transfer means is attached directly to said gripping means and is movable longitudinally of said body.

3. A pipette as recited in claim 1 wherein said spring forces said transfer means to an initial position.

4. A pipette as recited in claim 1, wherein said piston rod has teeth and said gripping means is a blade for engagement with said teeth.

5. A pipette as recited in claim 1, wherein said piston rod end has a pulling rod.

6. A pipette as recited in claim 1, wherein movement of said gripping means downward pushes said piston downward only over a part of the entire distance available for said piston to be moved.

7. A pipette as recited in claim 6, wherein said body has a step for limiting the top position of the piston movement.

8. A pipette as recited in claim 1 wherein, when moved downward, said gripping means is attached, at its side, to said piston rod and moves said piston downward, but when moved upward said gripping means is free of said piston rod.

9. A pipette as recited in claim 8, wherein said spring is connected to said gripping means of pushing said gripping means against said piston rod when said gripping means is moved downward.

10. A pipette as recited in claim 8 or 9, wherein a stop lifts said gripping means off said piston rod so that said piston rod can be pulled freely to said top position.

11. A pipette as recited in claim 1, wherein said cylinder and said piston are exchangeable.

12. A pipette as recited in claim 11, wherein said gap is on a pipette side opposite to said transfer means.

13. A pipette as recited in claim 11 or 12, wherein said cylinder top end has a flange and said body has a corresponding transverse groove into which said flange is pushed.

14. A pipette as recited in claim 1, wherein said pipette has means for controlling the distance of movement between a top and a lower portion of said gripping means.

15. A pipette as recited in claim 14, wherein said control equipment is a stop which is moved in the longitudinal direction of said body.

16. A pipette as recited in claim 15, wherein said gripping means is connected to a spring for pressing said gripping means against the piston rod when the gripping means is moved downward and said pipette contains a control rod the end of which functions as a stop for lifting the gripping means free of the piston rod in the top position and to which a control rod spring is attached for pulling the control rod downward.

17. A pipette as recited in claim 7, wherein said transfer means is connected to a lever articulated to the body for actuating said transfer means.

18. A pipette as recited in claim 17, wherein said lever can be turned downward.

19. A pipette as recited in claim 17 or 18, wherein said lever is articulated directly to said transfer means.

20. A pipette as recited in claim 18 or 19, wherein said lever is in the lower body part.

* * * * *